US007325481B2

(12) United States Patent
Helm

(10) Patent No.: US 7,325,481 B2
(45) Date of Patent: Feb. 5, 2008

(54) COOKING DEVICE WITH A FAN AND A WATER SUPPLY

(75) Inventor: Peter Helm, Wolfenbuttel (DE)

(73) Assignee: MKN Maschinenfabrik Kurt Neubauer GmbH & Co., Wolfenbuttel (DE)

( * ) Notice: Subject to any disclaimer, the term of this patent is extended or adjusted under 35 U.S.C. 154(b) by 0 days.

(21) Appl. No.: 10/497,221

(22) PCT Filed: Nov. 29, 2002

(86) PCT No.: PCT/EP02/13508

§ 371 (c)(1),
(2), (4) Date: May 28, 2004

(87) PCT Pub. No.: WO03/046438

PCT Pub. Date: May 6, 2003

(65) Prior Publication Data

US 2005/0109215 A1 May 26, 2005

(30) Foreign Application Priority Data

Nov. 29, 2001 (DE) ..... 101 58 425

(51) Int. Cl.
*A23L 1/00* (2006.01)

(52) U.S. Cl. ..... 99/330; 99/476

(58) Field of Classification Search ..... 99/326–333, 99/339, 340, 467, 473–476, 481, 451, DIG. 14; 126/20, 348, 369, 369.1, 369.2, 369.3; 219/400, 219/401, 601, 622, 731, 680, 682; 426/241, 426/248, 243, 523

See application file for complete search history.

(56) References Cited

U.S. PATENT DOCUMENTS 4,700,685 A 10/1987 Miller (Continued)

FOREIGN PATENT DOCUMENTS

DE 40 07 198 10/1991

(Continued)

*Primary Examiner*—Timothy F. Simone
(74) *Attorney, Agent, or Firm*—Salter & Michaelson

(57) ABSTRACT

A cooking device comprises a cooking chamber (11) and one or more heating elements (12). Furthermore, a blower (20) is provided, which comprises a radial blower impeller (22) and an atomisation element rotating with the radial blower impeller (22). A water supply (30) comprises at least one water outlet (33), which supplies water onto the atomisation element (25). An evaporation of the water and thus a humid cooking chamber air is achieved. The atomising element is a discoidal, axially-symmetrical element, the outer radius of which is the same as, or larger than the inner radius of the blade region of the radial blower impeller (22). The atomisation element is arranged adjacent to the radial blower impeller in the axial direction and the water outlet (33) is arranged adjacent to the atomisation element (25), outside the radial blower impeller (22).

13 Claims, 1 Drawing Sheet

U.S. PATENT DOCUMENTS

Figure 1:
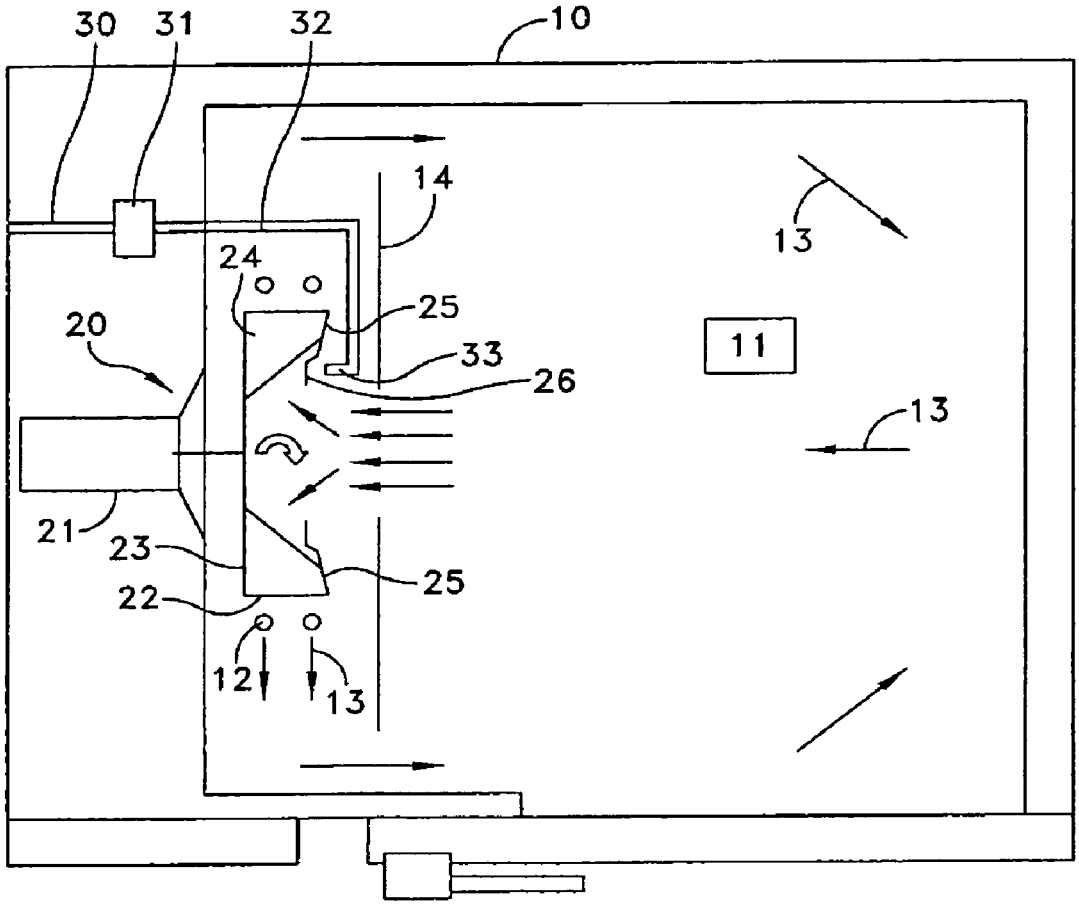

| | | | | |
|---|---|---|---|---|
| 5,517,980 | A * | 5/1996 | Cappello et al. | 126/20 |
| 5,530,223 | A | 6/1996 | Culzoni et al. | |
| 5,619,983 | A | 4/1997 | Smith | |
| 5,768,982 | A | 6/1998 | Violi et al. | |
| 6,070,517 | A * | 6/2000 | Helm | 99/330 |
| 6,318,246 | B2 * | 11/2001 | Fukushima et al. | 99/330 |

FOREIGN PATENT DOCUMENTS

| | | | |
|---|---|---|---|
| DE | 40 13 596 | | 1/1993 |
| DE | 41 25 696 | | 2/1993 |
| DE | 41 31 748 | | 3/1993 |
| DE | 197 31 544 | | 1/1999 |
| DE | 10260965 | A1 * | 9/2004 |
| EP | 0 233 535 | | 8/1987 |
| EP | 0 244 538 | | 11/1987 |
| EP | 0 383 366 | | 8/1990 |
| EP | 0 457 971 | | 11/1991 |
| EP | 0 523 489 | | 1/1993 |
| EP | 0 640 310 | | 3/1995 |
| EP | 0 653 593 | | 5/1995 |
| EP | 0 893 084 | | 1/1999 |

* cited by examiner

COOKING DEVICE WITH A FAN AND A WATER SUPPLY

TECHNICAL FIELD

The invention relates to a cooking device comprising a cooking area, one or more heating elements, a fan incorporating a radial flow impeller having a blade region, a disk-shaped axially-symmetrical atomization element which rotates with the radial flow impeller, and a water supply having at least one water outlet which delivers water to the atomization element.

BACKGROUND

Cooking devices are being equipped to an increasing extent with a steam generating system for improving the results of the cooking process with the help of the damp air which then ensues in the cooking area. Such cooking devices are, for example, combination steamers, baking-ovens or hot-air ovens. They serve, in particular, for the purposes of preparing food for consumption. On the one hand hereby, it is possible to produce steam by means of a steam generator located externally of the cooking area and then feed this steam into the cooking area through a connecting member.

However, in another concept of increasing interest, the steam is not fed into the cooking area from an external source but is produced directly in the cooking area. To this end, water is supplied to the cooking area and distributed therein in different forms and is thus evaporated by the hot environment.

For this purpose, water supply pipes are employed in accordance with the concepts known from EP 0 233 535 B1, EP 0 383 366 B1 or EP 0 640 310 B1 for example, said pipes supplying the water to the hub of the fan in a centrifugal fan. Due to the fact that the hub is rotating, the water is fed from the hub to the impeller blades of the fan by centrifugal force and there, the water is decomposed insofar as possible into drops which should then evaporate in the hot atmosphere of the cooking area. Hereby, the hub is approximately cylindrical in the case of EP 0 233 535 B1 and EP 0 383 366 B1, whilst EP 0 640 310 B1 proposes a pre-atomising member which is approximately spherical in shape and thus possesses a convex surface and hence is better at distributing the droplets.

In each of the respective proposals in accordance with DE 197 31 544 A1 and DE 41 31 748 C2, there are provided pre-atomising members in the form of disks which are located within the radial flow impeller and rotate with the hub. The disks are axially symmetrical. The water is delivered externally to the outer periphery of the disk in a radial direction in the case of DE 197 31 544 A1, whereas it impinges a very small part of the disk at an angle in DE 41 31 748 C2.

Herein, the heating of the atmosphere in the cooking area is effected by electrical heating elements or else by means of heat exchanger pipes through which there flows a hot medium so that they too function as a heating element. These heating elements are usually disposed directly in the flow path of the impeller in order to distribute the ensuing heat in a uniform manner.

Similar concepts are proposed in both EP 0 244 538 B1 and EP 0 523 489 B1, whereby here, the water is supplied internally in axially parallel manner to the interior of the hub from outside the cooking area through central passages in the hub, from where it is likewise distributed outwardly onto the fan blades. So as to make this possible, complicated seals and co-rotating clamping devices must be provided in order to maintain the stability of the cup-like hub (EP 0 244 538 81) or the cone-like extended hub (EP 0 523 489 B1), to prevent water seepage at unintentional places and in order to ensure proper functioning.

The disadvantage with all of the aforementioned concepts is that the peripheral speed of the described hub components is naturally relatively very low due to the proportionately small diameter of the hub. This relatively low peripheral speed leads to a relatively small centrifugal force and thus to a non optimal distribution of the water droplets which remain relatively large. If one were to increase the rotational speed of the fan i.e. the rotational speed of the fan motor in the fan in order to improve the effectiveness of the arrangement, then this would lead to the need for higher powered motors thereby increasing the costs both for the cooking device and for the operation thereof, this being something that is not desired. In addition, the higher air speeds then ensuing in the cooking area are neither necessary nor desirable.

Constructions have therefore been proposed in EP 0 457 971 B1, DE 40 13 596 C2 and DE 41 25 696 C1 wherein the water is not conveyed to the hub, but rather, is introduced into the air inlet region of the fan and distributed from there. Thereby, the water runs over a complicated cascaded distribution structure in EP 0 457 971 B1, it impinges directly on the blades in DE 40 13 596 C2, and, in DE 41 25 696 C1, it is proposed that the water be distributed individually via a plurality of water supply devices and delivered in front of the respective heating elements. The disadvantage of these constructions is the relatively high expenditure and the complexity of the final installation. This leads to high costs and, in particular, makes cleaning of the corresponding cooking devices substantially more difficult. In addition, the uniformity of the distribution process and thus the efficiency of the arrangements are unsatisfactory.

OBJECT OF THE INVENTION

In contrast thereto, the object of the invention is to propose a cooking device in accordance with the preamble of the main Claim wherein, with the aid of a device that is as constructionally simple as possible, there will nevertheless be obtained droplets of as small a size as possible which can then rapidly evaporate in the hot ambient air and thus achieve a high level of efficiency.

SUMMARY OF THE INVENTION

This object is achieved in that the atomization element has an external radius which is the same as or greater than that of the inner radius of the blade region of the radial flow impeller, in that the atomization element is arranged adjacent to the blade region of the radial flow impeller in the axial direction, and in that the water outlet is arranged in the neighbourhood of the atomization element on the side thereof remote from the blade region of the radial flow impeller.

The object is achieved in a surprising manner by virtue of this solution. The water from the water outlet now impinges on an atomization element which, in contrast to EP 0 640 310 B1 or the earlier state of the art, is of large radius so that the spin-off speed will be very substantial due to the centrifugal force at the periphery of this atomization element. At the same time, the quantities of water film distributed on the individual peripheral portions are also very much smaller and the film is very much thinner due to the large circumference, this thereby substantially favouring the formation of small droplets. The small droplets can then evaporate without difficulty in the atmosphere of the cooking area.

It is preferred that the atomization element should be on that side of the radial flow impeller which is remote from the neighbouring wall of the cooking area. The air flow and the arrangement of the heating elements then lead to a better evaporation effect.

It is of very especial advantage, if the atomization element is also the cover plate of the radial flow impeller at the same time. In any case, for the purposes of stabilizing the blades thereof, radial flow impellers already have a cover plate for holding these blades together on the side remote from the cooking area wall. This cover plate is a perforated plate which comprises a uniform, circularly symmetrical central hole in the region near the axis for the purposes of providing an entrance for the atmosphere of the cooking area which enters the radial flow impeller at this point in order to be spun outwardly in the usual manner. It does not have to be held on the axis since it is of course already connected to the blades in the blade region.

In the preferred embodiment of the invention, this cover plate can now take on the auxiliary task of catching the water originating from the water outlet and conveying it outwardly by centrifugal action.

Thus, other than is the case in practically all of the conceptions in the state of the art, the water no longer reaches the impeller blades. Conventionally, it had always been assumed that it was precisely these blades that were necessary in order to finely distribute the water droplets just by means of the force with which the water droplets struck there and burst apart. This latter effect does in fact occur, but the symmetrical, although not continuously running blade surfaces also lead to an intermittent distribution of the water droplets which, moreover, are braked in their flight and thus condense again instead of continuing the evaporation process that began when they were spun-off.

Now, in addition to the previously mentioned positive effect of spin-off from a position located substantially more distantly from the axis, the invention completely avoids the impingement of the water droplets on the blades of the impeller.

On the one hand, the water is now guided into a region where it is possible for the spin-off action produced by the centrifugal force to be effected at a very high speed, this thereby favouring the formation of very small droplets and thus increasing the evaporation effect and the efficiency.

On the other hand, it is at the same time possible to form a very thin water film since the distributed quantity of water is distributed over a large surface area and, due to the outward flow, it is also distributed over a very large periphery in proportion to the hub. The quantity of water per unit of periphery, i.e. per length, is very much smaller than in the case where spin-off occurs from the hub, this likewise favouring the formation of very small droplets with the same advantageous consequences.

At the same time, one can dispense with the provision of complicated constructions, possibly with re-entrant angles and regions that are difficult to clean. The only thing needed is a means for the supply of water to a readily accessible and thus easily cleanable position in the cooking area, namely, in front of the radial flow fan as seen by the user. Moreover, use is made of the exterior of the cover plate which of course already exists in the known radial fans and now merely serves an auxiliary purpose. In addition, this exterior of the cover plate is very easy to clean. If chalk deposits should develop, they can easily be removed from the surfaces since these are readily accessible, have no re-entrant angles and are also relatively flat. Moreover, the development thereof is also reduced due to the high speeds.

Thus, there are neither extensive auxiliary installations which create costs and make cleaning more difficult, nor is there a risk of calcification and blockage of the supply holes. Instead, the smallest of water particles are spun-off and the evaporation process is enhanced due to the advantageous use of a relatively large spin-off radius.

It is particularly preferred that the cover plate be provided with a radially symmetrical surface structure which forms a circumferential channel.

These effects are thereby reinforced, and the water emerging from the water outlet in the proximity of the cover plate can be collected in a particularly simple and at the same time secure manner, and uniform distribution of the water over the entire surface of the cover plate is ensured.

Moreover, it is particularly preferred that the cover plate of the radial flow impeller should be arranged radially symmetrically at an angle relative to the base plate which is greater than 5° and less than 90°.

In this way, premature separation of the water from the cover plate is reliably prevented and maximum acceleration of the water when being spun-off the outer periphery of the cover plate is achieved due to the additionally developed contact pressure.

An exemplary embodiment of the invention is described in more detail hereinafter with the aid of the accompanying drawing.

DETAILED DESCRIPTION OF DRAWINGS

Figure 2:
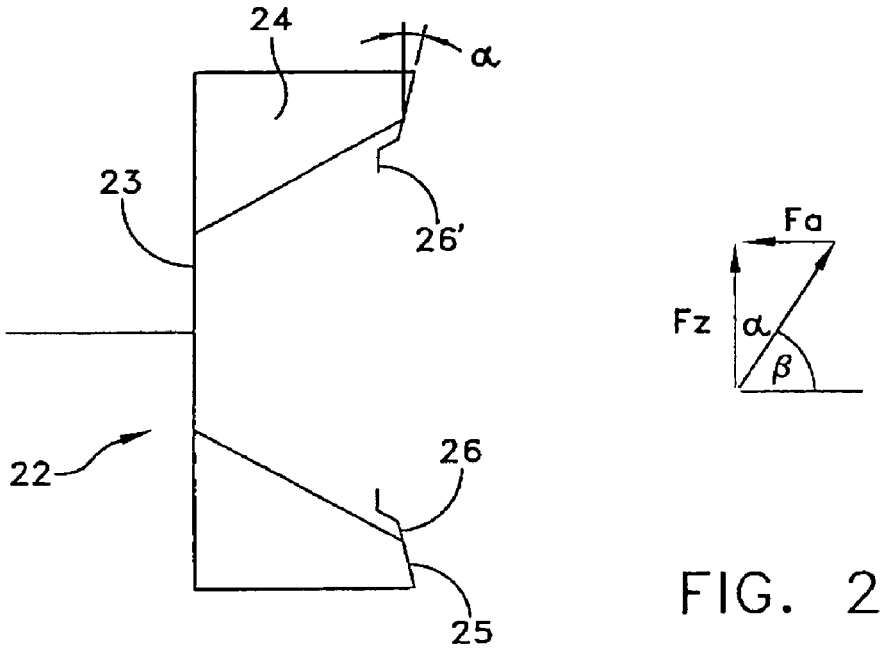

Therein:

FIG. 1 shows a sectional, schematic view of a cooking device according to the invention; and FIG. 2 an enlarged illustration of the cover plate of the radial flow impeller in the embodiment depicted in FIG. 1.

DETAILED DESCRIPTION OF PREFERRED EMBODIMENTS

A cooking device, for example a combination steamer, a baking-oven or other type of hot-air device is schematically illustrated in FIG. 1 in the form of a sectional view as seen by the user. This cooking device 10 includes a cooking area 11. A heating element 12 is provided in the cooking area 11 at the left-hand side although only two schematically-indicated turns thereof can be perceived. The heating of the cooking area 11 can be effected either by means of electrical heating elements 12 or else by means of heating elements 12 in the form of heat exchanger pipes through which a hot medium flows. Other types of device for producing heat could also be employed as heating elements 12.

A fan 20 is provided in order to uniformly distribute the heat produced by the heating element 12 or the air that has been heated thereby throughout the cooking area 11. This fan 20 includes a fan motor 21 which drives a radial flow impeller 22 in the cooking area 11. The radial flow impeller 22 is located within the heating element 12 and is radially surrounded thereby. The heating elements 12—whether electrical or in the form of heat exchanger pipes—are generally mounted in the direct field of flow from the radial flow impeller 22. Other arrangements are possible, but this has proved to be effective.

The radial flow impeller 22 comprises a base plate 23 upon which there are arranged a plurality of blades 24 that are perpendicular relative to the base plate 23 and radial relative to the axis. Thus, in like manner to the axis of the heating element 12, the axis of the radial flow impeller 22 lies in the plane of the picture in FIG. 1 and it extends horizontally therein. It follows therefrom that the base plate 23 of the radial flow impeller 22 is exactly perpendicular relative to the plane of the picture, namely, it is also perpendicular to the axis. The blades 24 can be curved or straight blades, but, in essence, they extend to the right from the base plate 23, i.e. parallel to the axis of the radial flow impeller 22.

As is usual in the case of radial flow impellers, the blades 24 are not seated on the axis, but rather, they leave the central region free so that air can flow into this region in parallel with the axis. At the same time, this forms the intake region of the radial flow impeller 22. Thus, the blade region is located between an inner radius, which is simultaneously the outer radius of the intake region, and an outer radius and is occupied by the blades 24. The outer radius also corresponds approximately to the radius of the base plate 23.

For the purposes of mechanically stabilizing the blades 24, they are supported by a cover plate 25 at the side thereof remote from the base plate 23. This cover plate 25 is flat in conventional radial flow impellers. To a first approximation, the cover plate 25 of the illustrated radial flow impeller 22 is also a flat disk which is perpendicular to the axis of the radial flow impeller 22. The cover plate 25 is provided with a hole centrally thereof, this hole too extending approximately from the inner to the outer radius of the blade region.

A water supply 30 is a further essential element in the combination steamer incorporating a steam generating system in accordance with the invention. This water supply 30 feeds water through a water dosing means 31 and a water supply line 32 into the cooking area 11. Water is expelled at the water outlet 33, that is to say, in the vicinity of the cover plate 25 of the radial flow impeller 22. Other than in the state of the art however, the water outlet 33 is not arranged within or between the base plate 23 and the cover plate 25, but rather, it is arranged outside the radial flow impeller 22 in the neighbourhood of that side of the cover plate 25 which is remote from the blades 24

The discharge from the water outlet 33 of the water supply 30 is pressure-free or free. As is also the case in EP 0 640 310 P1 for example, the water now reaches an atomization element, but this time, in a completely different position.

If one looks simultaneously at the flow arrows 13 in the cooking area 11 for the gas that has been heated by the heating element 12 and moved by the fan 20, then one sees that it is moved from left to right at the top and bottom of the cooking area 11, i.e. away from the fan 20, whilst it is sucked in centrally and around the axis of the radial flow impeller 22, i.e. it is moved from right to left in FIG. 1. This movement is also assisted by a metal sheet 14 which shields the heating element 12 in the cooking area 11 and thus forces the previously described direction of the flow arrows 13 which describe the flow path of the gas.

However, it is just this flow close to the axis in the direction of the radial flow impeller 22 of the fan 20 which also leads to the water droplets that have been set free at the water outlet 33 reaching the outer surface of the cover plate 25. In the embodiment illustrated here, the cover plate 25 is thus identical to the atomization element. The cover plate 25 rotates about the axis together with the other parts of the radial flow impeller 20. The peripheral speed of these components, and thus too, of the cover plate 25, leads to the water, which is now located on the outer surface of the cover plate 25, flowing radially outwardly and being accelerated in this direction. Consequently, the water flows outwardly on the cover plate 25, and thus, in the case of a rotating cover plate 25, upwardly and downwardly in FIG. 1 towards the viewer or away from him, that is to say, each water molecule separately, but all at the same time.

The relatively small flow rate of the water on the cover plate 25 together with the simultaneously proportionately large surface area of the cover plate 25 leads to a very thin film of water on the cover plate. This very thin film of water eventually reaches the outermost edge of the cover plate, i.e. the outer periphery thereof. Now it is precisely here where the highest centrifugal forces prevail. Consequently, the very thin film of water is torn off at this outermost edge of the cover plate i.e. the atomization element 25.

It is in this way that very small water droplets develop in the atmosphere of the gas in the cooking area 11, these then rapidly evaporate and thus produce the desired steam. Now this steam too follows the flow arrows 13 in the cooking area 11 so that, shielded by the metal sheet 14, the steam together with the other gases is distributed firstly in parallel with the axis to the right and then finally throughout the entire cooking area 11.

It can be seen in FIG. 1, but enlarged in FIG. 2, that the cover plate 25 in a preferred embodiment of the invention is not just a flat disk. It is optional, although preferred, that the cover plate 25 should be provided with a surface structure 26, in particular, with a kind of channel 26'. This channel optimises the collection of the water from the water outlet 33. As can be deduced from FIG. 2, the geometry of the arrangement is in each case radially symmetrical about the axis of the radial flow impeller 22. The channel 26' is thus circular circumferentially.

It is not possible for the water delivered from the water outlet 33 onto the outer surface of the cover plate i.e. the atomization element 25 to enter the radial flow impeller 22. Hereby, consideration should always be given to the centrifugal force which is exerted on the water droplets adhering to the cover plate 25 due to the rotation thereof. This is substantially greater than the other forces, thus, the force of gravity for example, which would like to move the water droplets downwardly, or the additional force in the direction of the flow arrows 13 which is exerted by the flow of gas and which would like to draw the water droplets inwardly into the fan.

Due to the contour, the structure or the channel on or in the cover plate 25, the water coming from the direction of the water outlet 33 is collected optimally and then distributed on the cover plate 25 with the help of the centrifugal forces. The illustrated contour is only one possible form of design. It is preferred that attention be paid to it being circumferentially symmetrical in order to obtain a uniform radially symmetrical distribution of the water droplets.

Likewise, a geometry is preferred which prevents the tendency of the water to enter the interior of the radial flow impeller 22 between the base plate 23 and the cover plate 25 following the flow arrows 13.

A particularly preferred form is obtained if the cover plate 25 is disposed at an angle $\alpha$ to the base plate 23 of the radial flow impeller 22 in radially symmetrical manner. This angle $\alpha$ corresponds to the angle 90°-$\beta$, which the surface of the cover plate 25 then includes with the axis of the radial flow impeller 22. This angle is schematically illustrated in FIG. 2. A contact pressure $F_a$ for the water on and against the cover plate 25 results from the centrifugal forces $F_z$ that are effective radially outwardly from the axis of the radial flow impeller 22. Consequently, the preferred relatively small angle $\alpha$ between the base plate 23 and thus the perpendicular from the axis of the radial flow impeller 22 on the one hand and the outwardly directed inclination of the cover plate 25 on the other now leads to the contact pressure $F_a$ preventing premature detachment of the water droplets from the cover plate 25, this thus achieving maximum acceleration of the water.

Moreover, due to the higher speed and the higher pressure, the thickness of the water film is smaller and still smaller drops will occur when the water film is torn off at the outer periphery. This, in turn, is of advantage for the formation of the steam.

The exact size of the angle a is relatively uncritical for developing the effect, however it is preferred that the angle $\alpha$ should be larger than 5° and smaller than 90°. This means that the angle $\beta$ should preferably be smaller than 85° and larger than 0°.

As can be perceived from FIGS. 1 and 2, the inner radius of the atomization element 25 i.e. the cover plate is such that the latter projects inwardly towards the blade region, i.e. it projects into the output region or somewhat modifies the external radius thereof, i.e. it narrows it. Consequently, the air flow must pass through a somewhat smaller opening than without the atomization element 25. This leads to a better overall flow behaviour and a more even distribution and acceleration of the water film.

REFERENCE SYMBOL LIST

10 cooking device
11 cooking area
12 heating element
13 flow arrows in the cooking area
14 metal sheet
20 fan
21 the motor of the fan
22 radial flow impeller
23 base plate of the radial flow impeller
24 blades of the radial flow impeller
25 atomisation element in the embodiment and, simultaneously, the cover plate of the radial flow impeller
26 surface structure of the cover plate
30 water supply
31 water dosing means
32 water supply line
33 water outlet
$\alpha$ angle of the cover plate with respect to the base plate
$\beta$ angle between the cover plate and the axis of the radial flow impeller
$F_Z$ centrifugal force
$F_a$ contact pressure or pressure force

The invention claimed is:

1. A cooking device comprising:
a cooking area;
one or more heating elements;
a fan which comprises a radial flow impeller having a blade region defined at least by axially displaced proximal and distal blade edges;
a disk-shaped cover plate which rotates with the radial flow impeller; and
a water supply which comprises at least one water outlet that delivers water to the cover plate;
wherein the cover plate is arranged adjacent the blade region of the radial flow impeller;
wherein the water outlet is arranged outside of said fan blade region, adjacent the cover plate and on the side thereof axially remote from the blade region of the radial flow impeller;
wherein the cover plate is arranged on that side of the radial flow impeller which is remote from the adjacent wall of the cooking area; and
wherein the cover plate is apertured in the center and the inner radius thereof forms the outer radius of the output region of the radial flow impeller.

2. The cooking device of claim 1, wherein the cover plate is provided with a radially symmetrical surface structure which forms a circumferential channel.

3. The cooking device of claim 1 wherein the cover plate has an outer radius which is the same as or larger than that of the inner radius of the blade region of the radial flow impeller as defined by the inner blade radius.

4. The cooking device of claim 1 wherein water expelled at the water outlet impinges on the annular cover plate, is distributed radially outwardly under centrifugal force and atomizes.

5. The cooking device of claim 1 wherein the blade region is defined radially between respective inner and outer blade radii, and the inner radius of the apertured cover plate is larger than the inner radius of the blade region.

6. A cooking device comprising:
a cooking area;
one or more heating elements;
a fan which comprises a radial flow impeller having a blade region defined radially between respective inner and outer blade radii and defined axially between respective proximal and distal blade edges;
an annular cover plate that defines an atomization element which rotates with and is at least partially supported by the radial flow impeller at the distal blade edge; and
a water supply which comprises at least one water outlet that delivers water to the cover plate;
wherein the water outlet is arranged outside of said fan blade region, adjacent the cover plate and on the side thereof axially remote from the blade region of the radial flow impeller;
wherein water expelled at the water outlet impinges on the annular cover plate, is distributed radially outwardly under centrifugal force away from said blade region and atomizes.

7. The cooking device of claim 6 wherein the cover plate has an outer radius which is the same as or larger than that of the inner radius of the blade region of the radial flow impeller as defined by the inner blade radius.

8. The cooking device of claim 6 wherein the cover plate has a channel and water formed thereon flows radially outwardly as the cover plate rotates with the radial flow impeller.

9. The cooking device of claim 6, wherein the cover plate is provided with a radially symmetrical surface structure which forms a circumferential channel.

10. The cooking device of claim 9, wherein the cover plate is radially symmetrical and is arranged at an angle $\beta$ to the axis of the radial flow impeller which is smaller than 85° and larger than 0°.

11. The cooking device of claim 6, wherein the cover plate is radially symmetrical and is arranged at an angle $\beta$ to the axis of the radial flow impeller which is smaller than 85° and larger than 0°.

12. The cooking device of claim 11, wherein the cover plate is arranged on that side of the radial flow impeller which is remote from the neighboring wall of the cooking area.

13. The cooking device of claim 6, wherein the cover plate is arranged on that side of the radial flow impeller which is remote from the neighboring wall of the cooking area.

* * * * *